US006698318B2

(12) United States Patent
Peters

(10) Patent No.: US 6,698,318 B2
(45) Date of Patent: Mar. 2, 2004

(54) WRENCH SET

(75) Inventor: David Peters, West Chester, OH (US)

(73) Assignee: Sawtek, Inc., West Chester, OH (US)

( * ) Notice: Subject to any disclaimer, the term of this patent is extended or adjusted under 35 U.S.C. 154(b) by 0 days.

(21) Appl. No.: 09/863,047

(22) Filed: May 22, 2001

(65) Prior Publication Data

US 2002/0174748 A1 Nov. 28, 2002

(51) Int. Cl.[7] ..... B25B 23/16; B25G 1/08
(52) U.S. Cl. ..... 81/177.4; 81/490
(58) Field of Search ..... 81/177.2, 177.4, 81/119, 124.4, 490, DIG. 8

(56) References Cited

U.S. PATENT DOCUMENTS

| | | | | | |
|---|---|---|---|---|---|
| 1,381,889 | A | | 6/1921 | Arnold | |
| 2,301,945 | A | | 11/1942 | Green | |
| 4,253,356 | A | | 3/1981 | Martinmaas | |
| 4,302,990 | A | | 12/1981 | Chrichton | |
| 4,352,306 | A | | 10/1982 | Martinmaas | |
| 4,352,307 | A | | 10/1982 | Martinmaas | |
| 4,627,315 | A | | 12/1986 | Lin | |
| 4,727,782 | A | * | 3/1988 | Yang | 81/177.4 X |
| 4,882,958 | A | * | 11/1989 | McNeeley | 81/124.4 |
| 4,926,721 | A | | 5/1990 | Hsiao | |
| 4,960,016 | A | | 10/1990 | Seals | |
| 5,148,724 | A | | 9/1992 | Rexford | |
| 5,421,225 | A | | 6/1995 | Chen | |
| 5,499,562 | A | * | 3/1996 | Feng | 81/177.4 |
| 5,517,885 | A | * | 5/1996 | Feng | 81/490 X |
| 5,613,413 | A | * | 3/1997 | Huang | 81/490 |
| 5,704,260 | A | | 1/1998 | Huang | |
| D431,983 | S | | 10/2000 | Peters | |
| 6,186,036 | B1 | * | 2/2001 | Huang | 81/490 |
| 6,314,600 | B1 | * | 11/2001 | Cachot | 81/490 X |
| 6,349,623 | B1 | * | 2/2002 | Peters | 81/177.4 |

OTHER PUBLICATIONS

American Hardware Manufacturers Association, *1999 New Product Exposition Directory*, Aug. 15–18, p. 28, Dess Industrial Co., Ltd., Booth 31807.

* cited by examiner

*Primary Examiner*—James G. Smith
(74) *Attorney, Agent, or Firm*—Wood, Herron and Evans, L.L.P.

(57) ABSTRACT

A wrench set includes a hollow body containing a tray. The tray includes a plurality of different size wrench heads held in a nesting relationship within said tray. The tray is easily removed from the hollow interior allowing a wrench head to be removed. Each wrench head is adapted to fit at the end of said hollow handle to permit its use and then can be returned to its tray and held within the hollow handle to provide a complete wrench set taking up minimal space.

7 Claims, 2 Drawing Sheets

WRENCH SET

BACKGROUND

Wrench sets generally include a plurality of wrenches with each wrench having a separate handle and a separate head. The heads are sized to engage different sized nuts or bolts. This takes up a large amount of space that is not a problem in many situations. However there are certain situations in which this is undesirable. In turn, a pair of pliers or an adjustable wrench is frequently substituted for the proper wrench. These are not as effective in engaging the head of a nut since there is generally some play in between the head of the nut and the head of the adjustable wrench or pliers. In particular, the pliers tend to strip the head of the nut.

Accordingly it is desirable to provide a compact wrench set.

SUMMARY OF THE INVENTION

The present invention is premised on the realization that a compact wrench set can be formed having a hollowed tapered handle with a plurality of different sized wrench heads within the hollow body of the wrench. More particularly the different size wrench heads can be held within the hollow interior or a wrench handle with the wrench heads nested upon each other and preferably held within a molded plastic tray which keeps all of the wrench heads together and easily available for use.

The objects and advantages of the present invention will be further appreciated in light of the following detailed description and drawings in which:

DETAILED DESCRIPTION

Figure 1:
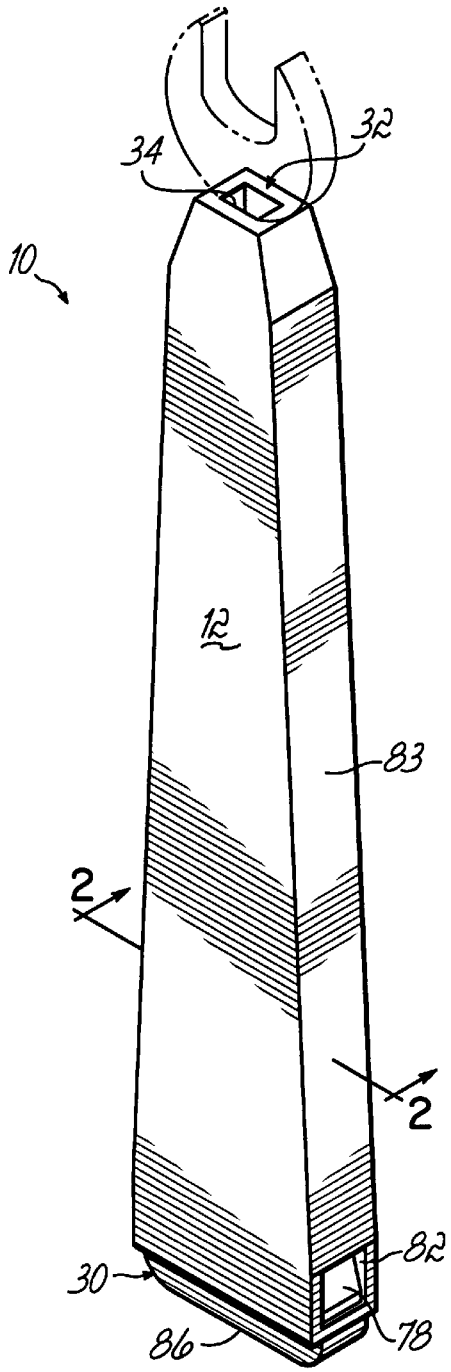
FIG. 1 is a perspective view of the present invention.
Figure 2:
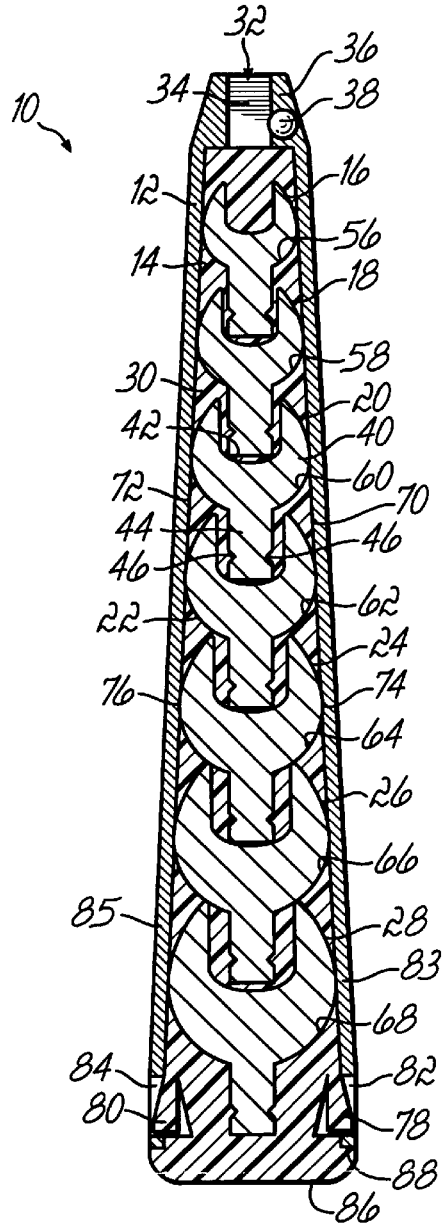
FIG. 2 is a cross-sectional view taken at lines 2—2 of FIG. 1.
Figure 3:
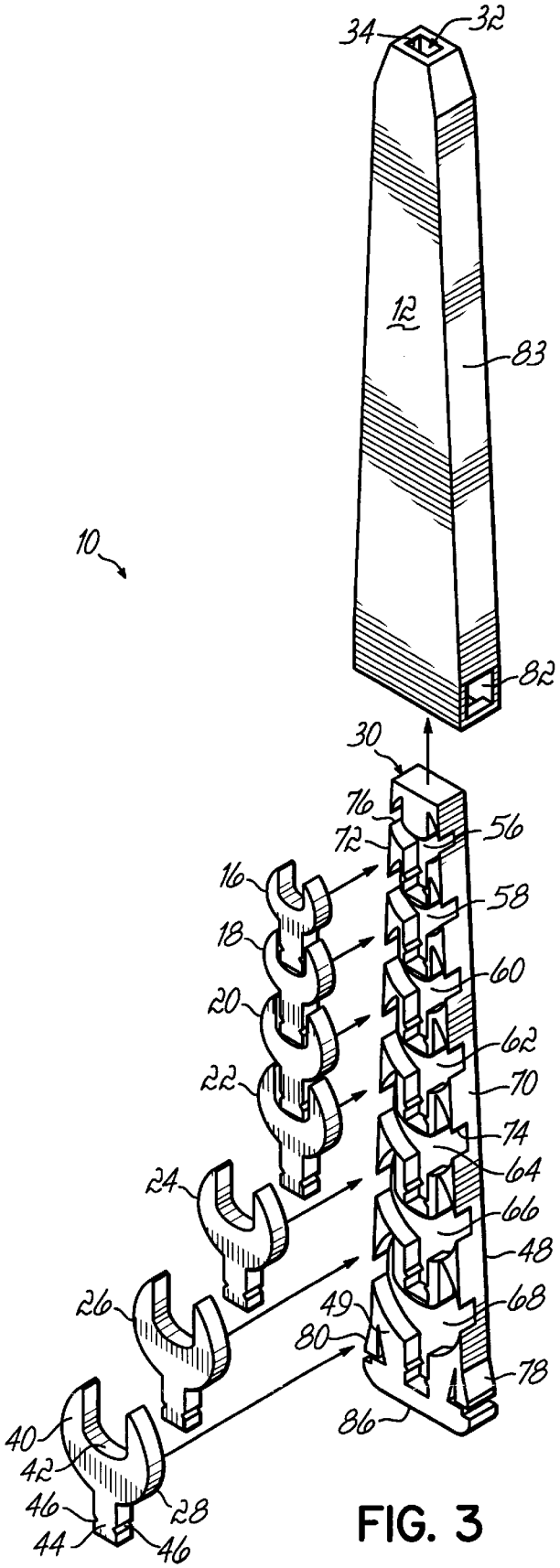
FIG. 3 is an exploded perspective view of the wrench set of the present invention.

As shown in FIG. 1, the present invention is a wrench set 10 which includes a tapered body or handle 12 having a hollow interior 14 which is rectangular in cross-section. Within the hollow interior 14 is a plurality of different size wrench heads 16–28.

The wrench heads are respectively held in a molded plastic tray 30.

The body 12 has a front opening 32 which leads into a rectangular passage 34 leading in to the hollow interior 14 of body 12. A detent or ball 38 is located within a wall 36 in the rectangular opening 34.

Each of the wrench heads 16–28 is a typical wrench head with the smallest wrench head 16 and the largest wrench head 28 and the remaining wrench heads having sizes adjusted there between. Each wrench head has a semicircular portion 40 and an opening 42 adapted to receive the head of a nut. Further, each wrench head includes a square stub 44. Each of these square stubs includes a pair of grooves 46 which are adapted to be engaged by the ball or detent 38.

Tray 30 includes a bottom wall 48 and a raised portion 49 that extends above the wall 48. The raised portion has a plurality of indented areas 56–68 which mate respectively with wrench heads 16–28. The tray further includes two side portions 70 and 72. At each indentation 56–68 there are an openings 74 and 76 through sides 70 and 72 respectively which permit one to grasp the semicircular portion 40 of each wrench head and to remove it.

The tray 30 further includes outwardly extended tabs 78 and 80 which are adapted to extend through openings 82 and 84 in the side walls 83 and 85 of body 12. The tray further includes a backwall 86 which engages a back edge 88 of the body 12.

In use, the different wrench heads are placed within the tray 30, the stub portion 44 of the smallest wrench 16 head nests in the open portion 42 of the next smallest wrench head 18, and each subsequent wrench head nests in the same manner. This reduces the overall required size of the handle. To be used, one simply presses the tabs 78 and 80 inwardly and pulls the tray 30 from the hollow interior 14. A wrench head is selected from the tray and with its stub pushed into channel 34 with the groove 46 engaging ball 38. Ball 38 is designed to move slightly and can be spring based if desired. The wrench handle can then be grasped and is ready to be used. The wrench handle is relatively narrow and rectangular although it can be if desired rounded to provide a different feel or grasp. When the wrench head is no longer needed, it is placed back in its indented area in the tray and the tray placed back into the hollow interior. Thus, this keeps the entire wrench set together and takes a minimal amount of space.

This has been a description of the present invention along with the preferred method of practicing the present invention.

However, the invention itself should only be defined by the appended claims wherein I claim:

1. A wrench set comprising a wrench body;

said wrench body having a hollow interior and an exterior wall;

a plurality of wrench heads each having a different size opening adapted to engage different size nuts or bolt heads;

each head being generally flat and having a stub;

said wrench body having an opening adapted to engage said stub; and a plurality of said wrench heads positioned in said hollow interior arranged according to size.

2. A wrench set comprising a tapered wrench body;

said wrench body having a hollow interior and an exterior wall;

a plurality of wrench heads each having a different size opening adapted to engage different size nuts or bolt heads;

each head having a stub;

said wrench body having an opening adapted to engage said stub; and said wrench heads nested in said hollow interior arranged according to size, with the stub of a first wrench head nested in the opening of the next adjacent wrench head.

3. The wrench set claimed in claim 1 wherein said stub has a rectangular cross-section.

4. The wrench set claimed in claim 1 wherein said wrench heads are nested in a tray adapted to slide into an opening of said wrench into said hollow interior.

5. The wrench set claimed in claim 3 wherein said wrench body has a rectangular interior cross-section.

6. The wrench set claimed in claim 5 wherein said wrench heads are nested in a tray adapted to fit within said hollow interior, said tray having first and second tabs adapted to engage first and second openings within said hollow body to thereby permit said tray to be retained within said body and to permit easy removal of said tray.

7. The wrench set claimed in claim 6 wherein said tray has first and second side walls and a plurality of separate indentations adapted to hold wrench heads and wherein each of said separate indentations has openings through said side walls permitting one to grasp side edges of the wrench heads.

* * * * *